US006691646B2

(12) United States Patent
Bartels et al.

(10) Patent No.: US 6,691,646 B2
(45) Date of Patent: Feb. 17, 2004

(54) COMPACT WATER LANCE BLOWER

(75) Inventors: Franz Bartels, Hamminkeln (DE); Alois Kessel, Voerde (DE); Jürgen Schröder, Oberhausen (DE); Stephan Simon, Hamminkeln (DE); Klaus Eimer, Ratingen (DE); Dieter Patzig, Ratingen (DE)

(73) Assignee: Clyde Bergemann GmbH, Wesel (DE)

( * ) Notice: Subject to any disclaimer, the term of this patent is extended or adjusted under 35 U.S.C. 154(b) by 0 days.

(21) Appl. No.: 10/237,231

(22) Filed: Sep. 3, 2002

(65) Prior Publication Data

US 2003/0070629 A1 Apr. 17, 2003

Related U.S. Application Data

(63) Continuation of application No. PCT/EP01/02287, filed on Mar. 1, 2001.

(30) Foreign Application Priority Data

Mar. 1, 2000 (DE) ..... 100 09 818

(51) Int. Cl.[7] ..... B08B 9/093

(52) U.S. Cl. ..... 122/390; 122/379; 134/22.12; 134/22.18

(58) Field of Search ..... 122/379, 390, 122/392, 405; 15/246.5; 134/18, 22.1, 22.12, 22.18, 181

(56) References Cited

U.S. PATENT DOCUMENTS

| | | | | |
|---|---|---|---|---|
| 5,503,115 A | * | 4/1996 | Franzke et al. | 122/390 |
| 5,882,430 A | * | 3/1999 | Kleye et al. | 134/18 |
| 6,283,069 B1 | * | 9/2001 | Bude et al. | 122/379 |

FOREIGN PATENT DOCUMENTS

| | | |
|---|---|---|
| DE | 196 37 700 A1 | 3/1998 |
| DE | 199 32 539 C1 | 8/2000 |
| WO | WO 93/12398 | 6/1993 |
| WO | WO 96/38701 | 12/1996 |
| WO | WO 96/38702 | 12/1996 |
| WO | WO 96/38703 | 12/1996 |
| WO | WO 96/38704 | 12/1996 |

* cited by examiner

*Primary Examiner*—Gregory Wilson
(74) *Attorney, Agent, or Firm*—Laurence A. Greenberg; Werner H. Stemer; Ralph E. Locher

(57) ABSTRACT

A water lance blower for cleaning heat installations is disclosed. A water lance linked with a water feed conduit system is swivel-mounted with its orifice disposed in a hatch. The water lance can blow a jet of water through the heating installation in operation and through which flames and/or flue gases are guided to wall areas that can be reached from the hatch. The water lance blower is provided with a drive system with at least two drive units that control the water lance, and with a holding device that fastens the water lance blower onto the heating installation. Further, parts of the water feed conduit system are integrated onto the holding device, thereby substantially limiting the size of the water lance blower to the swivel range of the water lance.

27 Claims, 6 Drawing Sheets

COMPACT WATER LANCE BLOWER

CROSS-REFERENCE TO RELATED APPLICATION

This application is a continuation of copending International Application No. PCT/EP01/02287, filed Mar. 1, 2001, which designated the United States and was not published in English.

BACKGROUND OF THE INVENTION

Field of the Invention

The invention relates to a water lance blower having a water lance.

Water lance blowers of this type are described, for example, in International Publication Nos. WO 96/38701 (corresponding to U.S. Pat. Nos. 6,283,069B1; 6,035,811A; 5,925,193A) WO 96/38702 (corresponding to U.S. Pat. No. 6,073,641A), WO 96/38703 and WO 96/38704 (corresponding to U.S. Pat. No. 6,101,985A). The water lance blowers emit a focused water jet through the furnace onto the opposite wall. As a result of the kinetic water jet energy and the sudden vaporization of water that has penetrated into pores of the deposits, flaking off of the soot, slag and ash soiling is carried out.

The area of impact of the water jet generated by the water lance blower generally follows a specific, pre-determinable path on the surface to be cleaned (known as a "blowing path"), wherein the path is generally in a wave-form, and possibly avoids obstacles, apertures or other sensitive zones.

In addition to the control of the drive system by a template, which necessarily generates a very specific blowing pattern, dual axis controls are mainly used, with control axes at right angles to one another. In particular, a horizontal and a vertical axis are used in order to be able to easily generate wave-form blowing patterns. As a result, drive systems of conventional water lance blowers are provided with a horizontally orientated and a vertically orientated drive unit. At least one of the two drive units is also fastened with appropriate devices directly to the heating installation. The second drive unit of conventional drive systems is provided with devices with which the second drive unit can be fixed to the first drive unit in order to produce dual axis control. The second drive unit is disposed such that, for example, it is additionally guided on the heating installation or parts of the drive system. Such a drive system is described, for example, in the International Publication No. WO 93/12398.

The drive units of individual, conventional drive systems are configured differently because of the different requirements (in relation to the fastening or guiding),. A drive unit is usually fixed onto a part of a framework. During operation, the drive unit moves the other drive unit and a water lance, and for reasons of stability and rigidity is configured particularly robustly. In contrast to this, the second drive unit that is coupled in particular to the water lance is matched to the structural configuration of the first drive unit. Specially configured retaining and fastening devices are therefore necessary.

Furthermore, the individual components (such as, for example, the drive system, the water supply line and the control cabinet) of conventional water lance blowers are disposed around a centrally positioned water lance so that they are disposed in areas outside the slewing range of the water lance (in order not to limit the slewing range).

Additionally, the water lance is connected to a water supply line that has to follow the movements of the water lance, while at the same time not restricting the water lance.

Thus, such a water supply line of conventional water lance blowers is directly removed from the slewing range after leaving the water lance. For these reasons, conventional water lance blowers require substantially more space than the actual movement of the water lance necessitates. This is particularly problematic when the place where a water lance blower is installed is delimited by a large number of the structural requirements of the heating installation such as, for example, pipelines, supports, armatures and so forth. It is thus conceivable that the positioning of conventional water lance blowers at a desired place on the heating installation cannot be carried out, since there is insufficient space for the entire water lance blower, even though the required slewing range for the water lance would be provided.

The different embodiments of water lance blowers demand a high degree of logistical complexity in production, operation and service. Production includes a large number of manufacturing processes that are dependent on the different types of drive units of the embodiment. A wide range of machines and tools, as well as specially trained personnel are required for this purpose.

SUMMARY OF THE INVENTION

The invention relates to a water lance blower with a water lance that is pivotably disposed with its mouth on or in a hatch, with a drive system that is provided with at least two drive units for controlling the water lance, and with a retaining device for fastening the water lance blower to a wall. Such water lance blowers are used in particular for cleaning heating installations, wherein the water lance can blow a jet of water through the heating installation that is in operation and through which flames and/or smoke flow onto wall areas reachable via the hatch.

It is accordingly an object of the invention to provide a compact water lance blower that overcomes the hereinaforementioned disadvantages of the heretofore-known devices of this general type, and that is easy to assemble and to service and which reduces the logistical demands described hereinabove to one operation, whereby the water lance can be controlled along pre-determinable blowing patterns at different speeds.

With the foregoing and other objects in view, there is provided, in accordance with the invention, a water lance blower connected to a water supply system for cleaning a heating installation containing a hatch. A water lance having a mouth is pivotably disposed in the hatch. A drive system has at least two drive units for controlling the water lance and a retaining device for attaching the water lance blower to the heating installation. The retaining device has parts of a water supply system integrated into the retaining device.

The water lance blower is particularly compactly configured by integration of parts of the water supply into areas of the water lance blower that are disposed close to the water lance.

The retaining device also represents a kind of adaptor between a usually rigidly configured water supply line and a moveable, flexible mechanism for conducting the water to the water lance. The conducting mechanism is moved only in a relatively small section, whereby lesser forces are required for moving the water lance and the space in which parts of the water lance blower move are clearly reduced. It is precisely the reduction in the movement space that results in the positioning of the water lance blower according to the invention, thereby no longer necessitating a complex matching of the water supply system with the structural circumstances of the heating installation.

In accordance with another feature of the invention, the retaining device is provided with at least one connecting device for a separate water supply line. In particular, the use of standardized connecting devices is advantageous, whereby the water supply lines can be constructed rigidly, for example, as conduits. Furthermore, the retaining device has at least one connecting element for a flexible line for conducting water to the water lance. The configuration of the connecting element can be constructed flexibly. In a manner similar to the water conducting line, the connecting element is orientated towards the water lance (wherein the desired slewing range of the water lance is not limited).

In accordance with a further feature of the invention, the retaining device is provided with at least one distributor that divides a flow of water flowing through and connects the water supply line to at least two connecting elements. A large flow of water can thereby be subdivided into several streams of water such that a configuration of the more flexible water conveyance to the water lance that is appropriate for the application is possible.

In accordance with an advantageous configuration of the water lance blower, at least one valve is integrated into the retaining device. The valve serves to regulate the pressure generated in the nozzle of the water lance, whereby the quality of the water jet generated can be easily influenced, in combination with a control unit by an operator.

In accordance with a further configuration, the flexible line is provided as a flexible hose system from the retaining device to the water lance, wherein the water flow is divided into two or more parallel hoses. The distribution of the water flow can take place either within the retaining device, as, for example, with a distributor, or through the hose system itself. The distribution of the water flow into two or more hoses results in substantially smaller radii of bending in the hose system, and thus contributes to the compactness and flexibility of the water lance blower.

It is particularly advantageous to configure the hose system with four hoses that are disposed such that each hose is disposed with the center point of its cross-section at the corners of an imaginary square. In this way, preferred directions of bending of the hose system are produced, which can be orientated according to the desired paths of motion of the water lance. The hoses can be fixed in this configuration using simple mechanisms such as, for example, cable ties.

In accordance with a further development, the hose system is configured with three or more hoses that are disposed with the center points of their cross-sections in a square. The orientation of the hose system also has to be matched to the paths of motion of the water lance such that friction upon the hose walls is as low as possible.

According to a further embodiment, the hose system is provided with a hose jacket that surrounds, at least in part, two or more hoses. This can be done, for example, in areas of the hose system particularly stressed by bending or soiling. It is particularly advantageous when the hose jacket is provided with an anti-friction agent (for example, talcum) distributed substantially between the hose jacket and the hoses. In this way, friction occurring externally on the hose walls during bending stress is reduced.

It is particularly advantageous when the parts of the water supply system integrated into the retaining device are disposed in a concentrated manner in one corner of the drive system. In this way, the range of movement of the water lance is not limited.

It is particularly advantageous (also independent of the rest of the configuration of the retaining device), when the drive system of the water lance blower is provided with two drive units that are distinguished in that they are configured as modules. This means that the drive units form autonomous functional units and are completely exchangeable. Consequently, identically configured drive units configured in this way in a drive system are also mutually exchangeable. This has the advantage that, for example, during repair, the drive unit can simply be removed and replaced with a new drive unit. A modular embodiment of the drive units additionally reduces the logistical complexities for a business, which now need only manufacture, store and logistically manage a reduced number of variants of the drive units. This substantially reduces the manufacturing and servicing costs for the business.

Such a configuration of the drive system further supports the compact and simple configuration of the water lance blower.

The fastening of the retaining device to a heating installation can thus be carried out in the position desired. Proceeding from this position, the drive units can be disposed as desired. Thus, possibly taking into account the components of the heating installation, the drive units can be combined in such a manner that a desired pivoting range of the water lance can be implemented.

Accordingly, the first and second drive units are disposed perpendicular to one another and connected together. The first is connected to the retaining device, and the second drive unit is guided by the first. The second drive unit articulates the water lance so that the terminal area thereof can sweep a maximum projection surface during operation. A configuration of the drive units is thus produced, which is L-shaped in the edge positions of the path of travel of the first drive unit, and T-shaped in a central position of the path of travel. The orientation of the L or T-shaped configuration is unimportant. A frame is not needed for such a configuration. The configuration of the integrated parts of the water supply line in the area of a corner of the projection surface of the water lance is advantageous and particularly preferred.

According to a further embodiment, the second drive unit of the drive system is configured with a connecting element that projects laterally from the second drive unit. The water lance is articulated with the end of the connecting element. The connecting element is configured such that the freedom of movement of the water lance is not limited. The connecting element is also disposed such that the projecting end is orientated to the side of the drive system of the water lance blower opposite the retaining device that in particular has integrated parts of the water supply line.

The orientation of the connecting element results in a very compact and space-saving water lance blower, since in this way the drive units and the retaining device are substantially disposed on a surface that can be pivoted over by the rear end area of the water lance. The connecting element is thus moved in a plane by two drive units, and consequently makes movement of the water lance possible. The point of articulation of the connecting element varies because of the different positions of the water lance. If the water lance is greatly inclined (for example, when both drive units are close to an edge position), the articulation point moves in the outer area of the water lance towards the flexible line. In an upright position, the point of articulation is closer to the mouth of the water lance.

Furthermore, at the external ends, certain devices must be provided for fastening the flexible line, which do not limit the freedom of movement of the water lance. For this reason, the water lance is not articulated at its external end to the connection element, but instead extends further beyond the point of articulation. During operation of the water lance blower, the outermost end of the water lance sweeps a maximum surface upon which (with an appropriately equipped connecting element) the drive units and the retaining device with integrated parts of the water supply line are disposed.

According to a further configuration, the modular drive units are each provided with at least a motor, a spindle and a spindle nut. The motor is connected to the spindle, and consequently turns the spindle during operation, whereby the spindle nut mounted on the spindle is moved in a translatory manner. Such drive units are particularly suitable for accurate path controlling. In addition, they are distinguished by their simple construction.

In accordance with a further development, the water lance blower is provided with a guidance system with slide shoes and rails. The spindle nut is connected to the slide shoes. The slide shoes are guided by two parallel rails. The rails are directly fastened to the drive unit and orientated such that they are parallel to the spindle. In this way, the bending and torsional rigidity of the drive unit is increased.

It is particularly advantageous to configure the motors of the drive units as electronic communication (EC) motors. EC motors can be optimized according to the purpose of their application, which consequently enables reliable path movement of the spindle nut. Furthermore, the motors are distinguished by a low heat development, high revolution speeds, and the possibility of sensing the speeds of revolution in order to determine the paths covered by a spindle nut connected via a spindle. It is particularly advantageous when, in addition to control of the path of the water lance by the motors of the drive units, the water lance is configured with a movement sensor that notifies faults in the transmission of movement.

According to a further development, the slide shoes are connected to a fastening element. The fastening element may be connected to all those slide shoes that are moved in a translatory manner on a rail. Alternatively, it may be connected to all of the slide shoes. If the fastening element is connected to all the slide shoes, this represents a platform that covers an area between the rails and fixes the spindle nut. A fastening element configured in this way significantly increases the torsional rigidity of the drive unit.

According to a further configuration, the fastening element has positioning aids for accurate orientation of structure that can be attached to the fastening element. The fastening element represents a kind of intersection with respect to the structures that are moved by the drive unit. Such structures include, for example, a further drive unit, the connecting element for fixing the water lance and components that are part of a guideway on the heating installation. Accurate path control of the water lance along predetermined blowing patterns at desired speeds requires accurate orientation of the structures on the drive unit. Faulty assembly is prevented using such positioning aids.

It is particularly advantageous to configure the positioning aids as pins, grooves or bores. The positioning aids can also be configured in combination as desired on a fastening element. With appropriate configuration of the structures to be attached, the positioning aids enable a kind of form locking, and consequently support fixing the structures in a pre-determinable position.

According to a further development, a second drive unit can be fixed onto a fastening element of a first drive unit. This means that the first drive unit is configured such that it can be attached to the fastening element, thereby ensuring cooperation between positioning aids and the second drive unit. Two drive units configured in a modular manner can thus be easily assembled to form a dual axis control for a water lance blower.

According to a further configuration, the drive unit has a cage-like profiled rail and a cover. The cage-like profiled rail and the cover at least partially enclose the components of the drive unit that are sensitive to soiling. For, example, the motor, the spindle, the spindle nut, and the parts of a translatory guidance system with slide shoes and rails are particularly sensitive to soiling. The drive system for a water lance blower is exposed to a large degree to a wide variety of environmental conditions because of the location where it is mounted. The large amount of soot or ash in the surrounding air, as well as possible leaks or water spray, are kept away from the spindle and guidance system in this way.

The rails of the guidance system are attached to the cage-like profiled rail. The side walls of the profiled rail at least partially enclose the rails and the slide shoes guided upon them. The cover is disposed above the spindle, and extends substantially between the side walls of the profiled rail. The configuration of the profiled rail and cover is preferably provided such that the internal and soiling-sensitive components are almost completely enclosed.

It is particularly advantageous to dispose the fastening element outside the cage-like profiled rail. The connection of the fastening element to the slide shoes in the inside of the profiled rail is configured such that the areas of the profiled rail lying inside are sealed against soiling. Consequently, the spindle and the guidance system are protected, and the fastening element additionally offers an external possibility for connection.

The configuration of the profiled rail and cover described results in the formation of at least one gap. The gap is necessary for transferring the movement of the spindle nut to external structures, in particular the water lance of the water lance blower.

According to a further configuration, the drive system is provided with at least one expansion bellows that is disposed such that it at least partially seals at least a gap between the profiled rail and cover. It is particularly advantageous to connect the expansion bellows on the one hand by its end to the cage-like profiled rail, and on the other hand to the fastening element. The expansion bellows is then provided in particular on the profiled rail, and consequently covers the at least one gap between the profiled rail and cover.

In accordance with another configuration, the expansion bellows is not connected to the movable fastening element, but provides protection during periods when the water lance blower is non-operational. This means that the expansion bellows is moved into a position at the beginning of the water lance blower's cleaning cycle in which it extends only over the edge areas of the gap, and after the cleaning cycle ends, is extended again, and consequently covers the at least one gap as far as the fastening element. The configuration is particularly suitable in combination with additional sealing mechanisms on the gap that prevent penetration of soiling agents into the internal areas of the drive unit during operation of the water lance blower.

According to a further configuration of the water lance blower, at least one slide shoe is respectively connected to a rail with a shuttle. In this way, the fastening element can be attached both between the slide shoe and shuttle and onto the side of the shuttle facing away from the slide shoes. If the at least one shuttle serves as an interface with further structures, it is preferably provided with positioning aids. A shuttle is to be understood as an elongate structure that tapers at its narrow ends such that a wedge shape is formed. The shuttle is disposed in a gap between the profiled rail and the cover, and consequently protrudes out over the cover.

In accordance with a further development of the drive system, areas between stationary parts of the drive units such as, for example, the profiled rail or the cover, as well as the moveable parts (fastening element or shuttle) are configured with a sealing mechanism. The sealing mechanism is robustly configured because of the accelerations and speeds occurring during operation of the water lance blower. Furthermore, the sealing mechanism is matched to the external environment, wherein the temperature sensitivity of the sealing mechanism is of prime importance, since the drive system is usually attached directly to the heating installation.

In a further configuration, the profiled rail and the cover are provided with rubber lips, which extend over the gap and lie against the shuttle. Preferably, the rubber lips are configured such that the rubber lips of the profiled rail and the cover of a gap at least partially touch one another. When there is a translatory movement of the spindle nut, the shuttle is moved between the rubber lips of a gap. The wedge-shape of the shuttle opens the rubber lips. Rubber lips configured in this way seal the gap between the cage-like profiled rail and the cover, thus protecting areas inside.

Another particularly advantageous configuration of the water lance blower is provided with two bands for sealing the gap in the drive unit. The bands are connected to the profiled rail and to the cover, and extend over the gap that has to be sealed. The moveable structure is configured between these bands. It is particularly advantageous to use an outwardly orientated metal band and an inwardly orientated rubber band. The bands are located in areas separated by the moveable structure, and open in the proximity of the moveable structure. The metal band represents, for example, a good protection against ash and so forth, while the flexible and elastic rubber band matches with the moveable structure particularly well.

According to yet another configuration, air at overpressure can be introduced into the profiled rail. The air substantially disperses through the gaps between the profiled rail and cover. The penetration of dirt and soot from the drive system environment is prevented because of the airflow from internal areas of the profiled rail outwards.

According to a further development of the water lance blower, the retaining device is distinguished by integrated control elements for at least one drive unit, or for forming and monitoring a water jet. The control elements influence, for example, the speed of revolution of the motor or regulate the water flow blown from the water lance.

It is particularly advantageous to equip the retaining device with control indicators and/or operating elements with which the control elements can possibly be influenced. In this way, the water lance blower can be controlled and steered locally by an operator. Integration of the control elements as well as control indicators and operating elements results in a very compact configuration of a drive system for a water lance blower.

In accordance with a concomitant feature of the invention, the retaining device has connectors for a remote control and/or remote diagnostics. This means that, for example, the control elements are configured to be connectable via a bus system with a remote diagnostic station. Consequently, remote monitoring of the mode of functioning of the water lance blower is enabled.

Other features which are considered as characteristic for the invention are set forth in the appended claims.

Although the invention is illustrated and described herein as embodied in a compact water lance blower, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
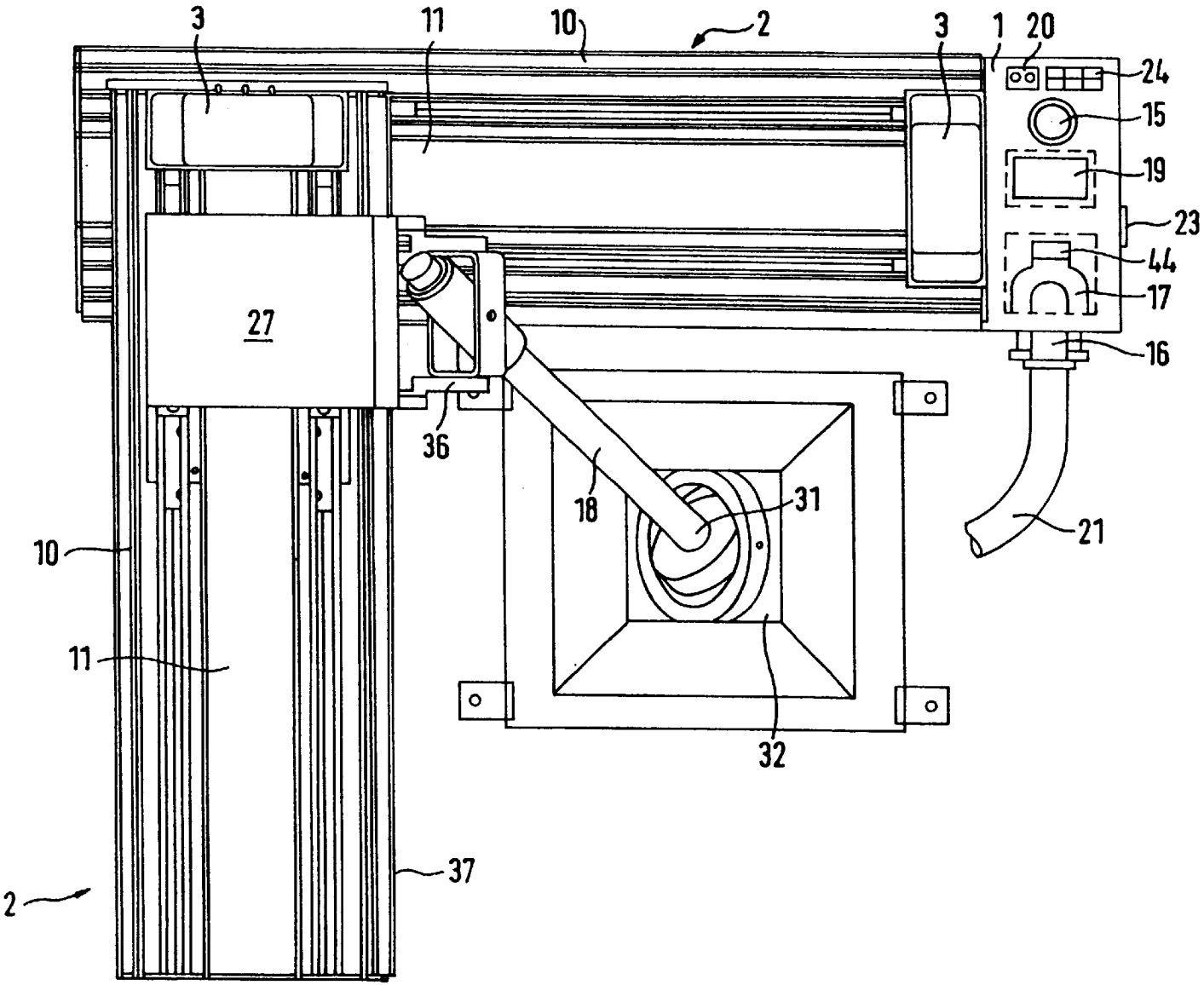
FIG. 1 is a diagramtic, elevational view of a water lance blower according to the invention.

Referring now to the figures of the drawings in detail and first, particularly to FIG. 1 thereof, there is shown a water lance blower. A water lance 18 is on the one hand pivotably disposed with its mouth 31 in a hatch 32, and on the other hand connected to a not-illustrated hose system 21. The water lance 18 is moved with two drive units 2 (which are configured in a modular manner), each provided with a motor 3, a profiled rail 10 and a cover 11. A first vertically orientated drive unit 2 is attached by a retaining device 1 to the heating installation. The vertically orientated drive unit 2 is connected to a second, horizontally orientated drive unit 2. The water lance 18 is articulated by a connecting element 27 with an end 36 projecting laterally 37 from the horizontally orientated drive unit 2.

Parts of a water supply system are integrated into the retaining device 1. The retaining device 1 is thus provided with a connecting device 15 onto which a separate water supply line can be connected. A distributor 17, which divides the flow of water supplied into several streams of water and conducts them to a corresponding number of connecting elements 16, is disposed inside the retaining device 1. In addition, the retaining device 1 is provided with a valve 44 for regulating the water pressure. The conduction of the water from the connecting elements 16 to the water lance 18 is done by a flexible hose system 21.

The retaining device 1 is configured with different control indicators 20 and operating elements 24 with the aid of which the operational behavior of the water lance blower can be observed and possibly be influenced. Steering elements 19 disposed in the retaining device 1 can be influenced by the operating elements 24. The steering elements monitor and regulate at least one motor 3 of a drive unit 2 and/or the formation of a water jet. The connectors 23 enable transmission of the data that describe the operating behavior of the water lance blower to a not-illustrated remote diagnostic unit.

Figure 2:
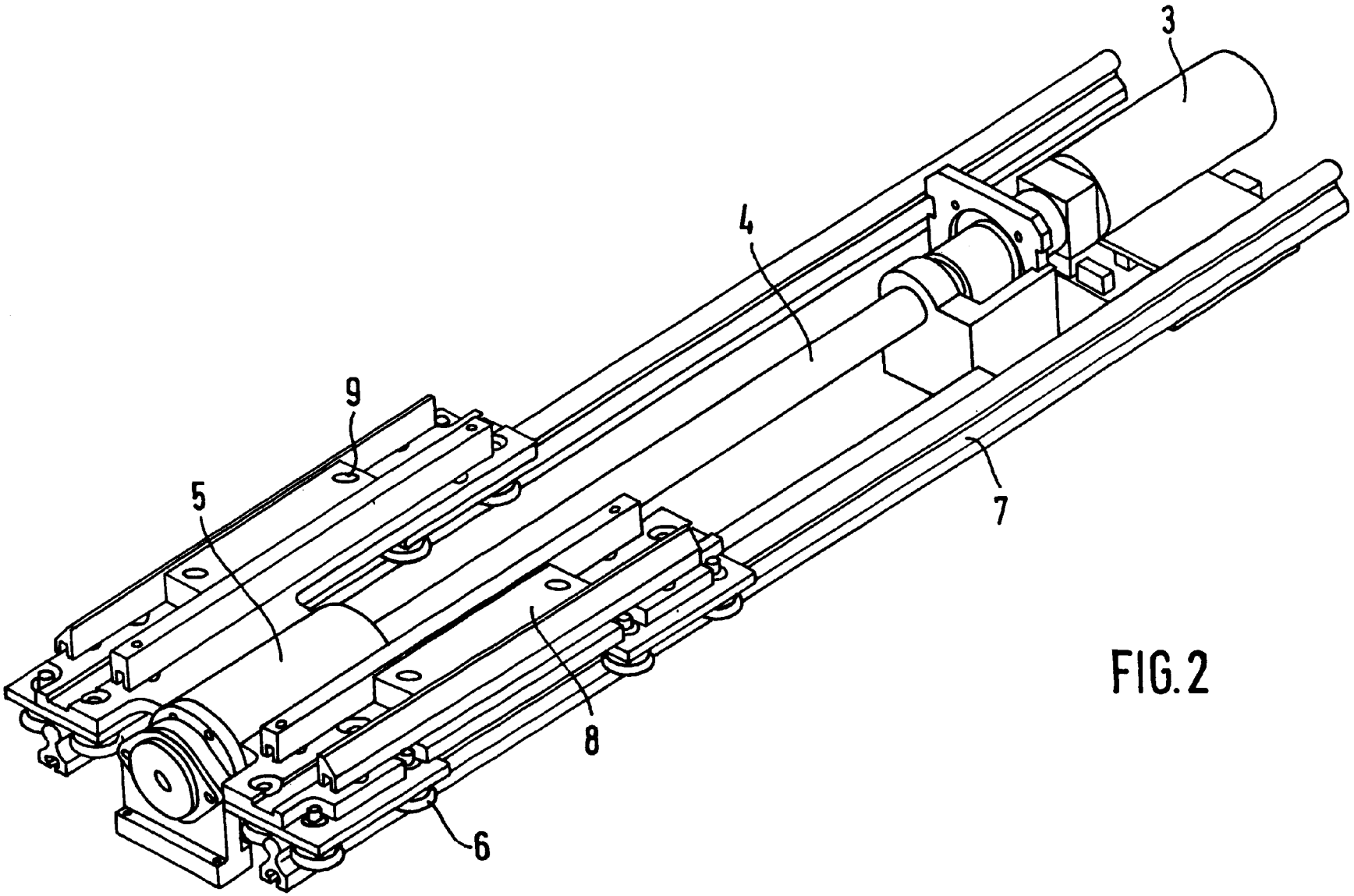
FIG. 2 is a perspective view of an embodiment of a drive unit.

FIG. 2 shows a detailed perspective and diagramatic view of an embodiment of a drive unit 2. It shows a configuration of the components of a spindle and guidance system in the inside of a not-illustrated profiled rail 10 and cover 11. A motor 3 is connected to a spindle 4, which enables the transmission of a turning moment. A spindle nut 5 is disposed on the spindle 4 that can be moved in a translatory manner on the spindle 4.

The spindle nut 5 is connected to slide shoes 6. The shoes 6 are guided on two rails 7 orientated parallel to the spindle 4. Such a guidance system significantly increases the torsional rigidity of the drive system. Furthermore, the spindle nut 5 is connected to a fastening element 8 that has positioning aids 9 for accurate orientation of structures that are to be attached. Due to the fact that during operation of the drive units, relative movements take place between the spindle nut 5 and spindle 4 and between the rails 7 and the slide shoes 6, the drive unit 2 must be configured in a manner such that it is sealed against soiling and water. The advantageous embodiments of such a configuration are shown in FIGS. 3–4.

Figure 3:
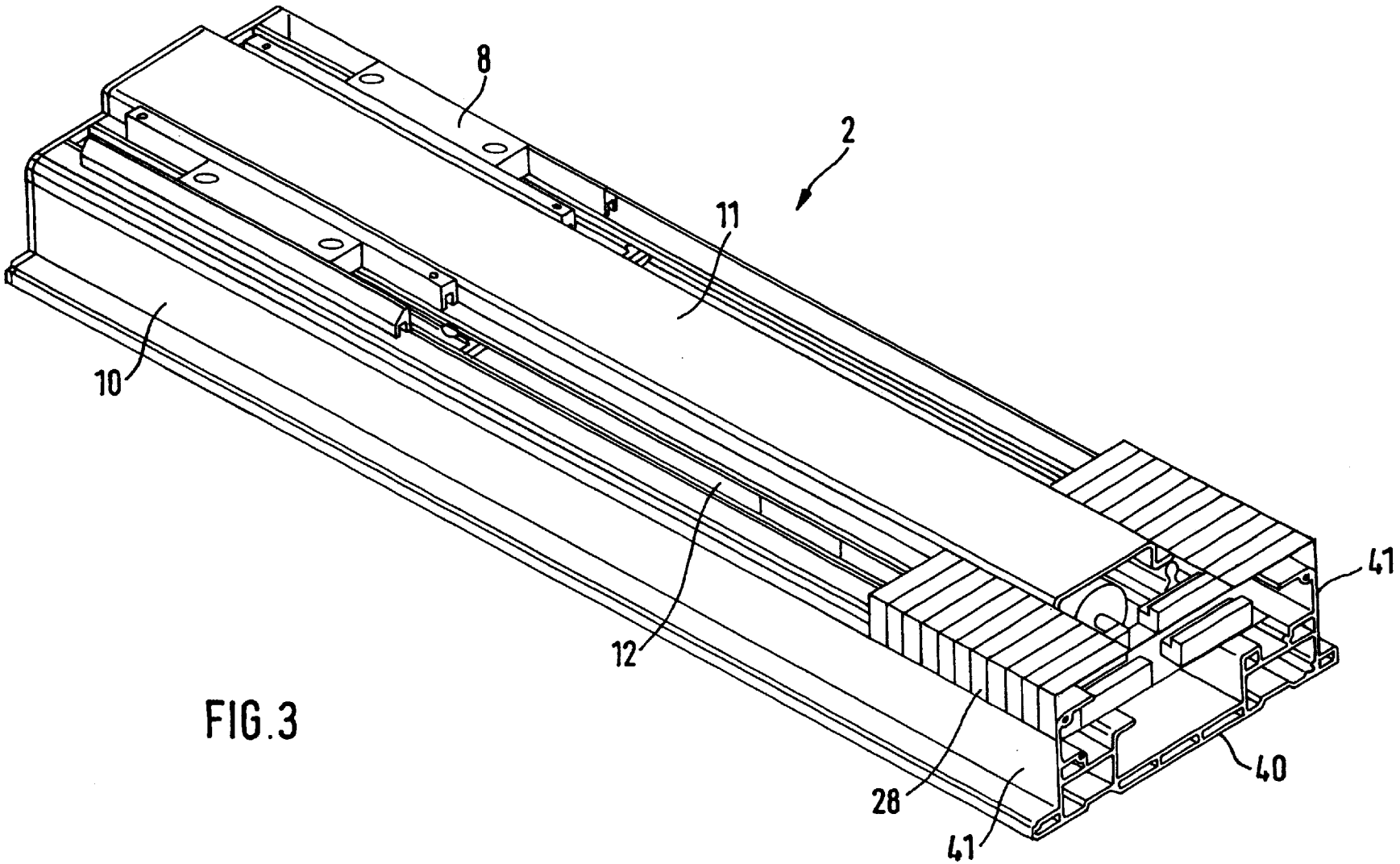
FIG. 3 is a perspective view of an embodiment of a drive unit with a sealing mechanism.

FIG. 3 shows a perspective representation of an embodiment of a drive unit 2. The external structure of the drive unit 2 is formed by a cage-like profiled rail 10. The profiled rail 10 has a base plate 40 and two side walls 41. A gap 12 is respectively formed between the side walls 41 of the profiled rail 10. A fastening element 8 is disposed outside the profiled rail 10 and thus provides possibilities for attaching further parts of the water lance blower.

The embodiment shown has two expansion bellows 28 that extend at least partially over the gap 12. The expansion bellows 28 are not moved with the fastening element 8 when the water lance blower is in operation, but are positioned prior to the start of the cleaning cycle in the manner shown. In the embodiment shown (with the expansion bellows 28), the protection of the gap 12 is supplemented additionally by the configuration of not-illustrated bands. The fastening element is disposed between an outer metal band and an inner rubber band. After the cleaning cycle, the expansion bellows 28 are pulled such that the entire gap 12 is covered as far as the fastening element 8. It is also possible to cover the gap 12 on both sides of the fastening element 8 respectively with an expansion bellows 28, where the fastening element 8 does not have to be conveyed into a specific position close to the end of the drive unit 2.

Figure 4:
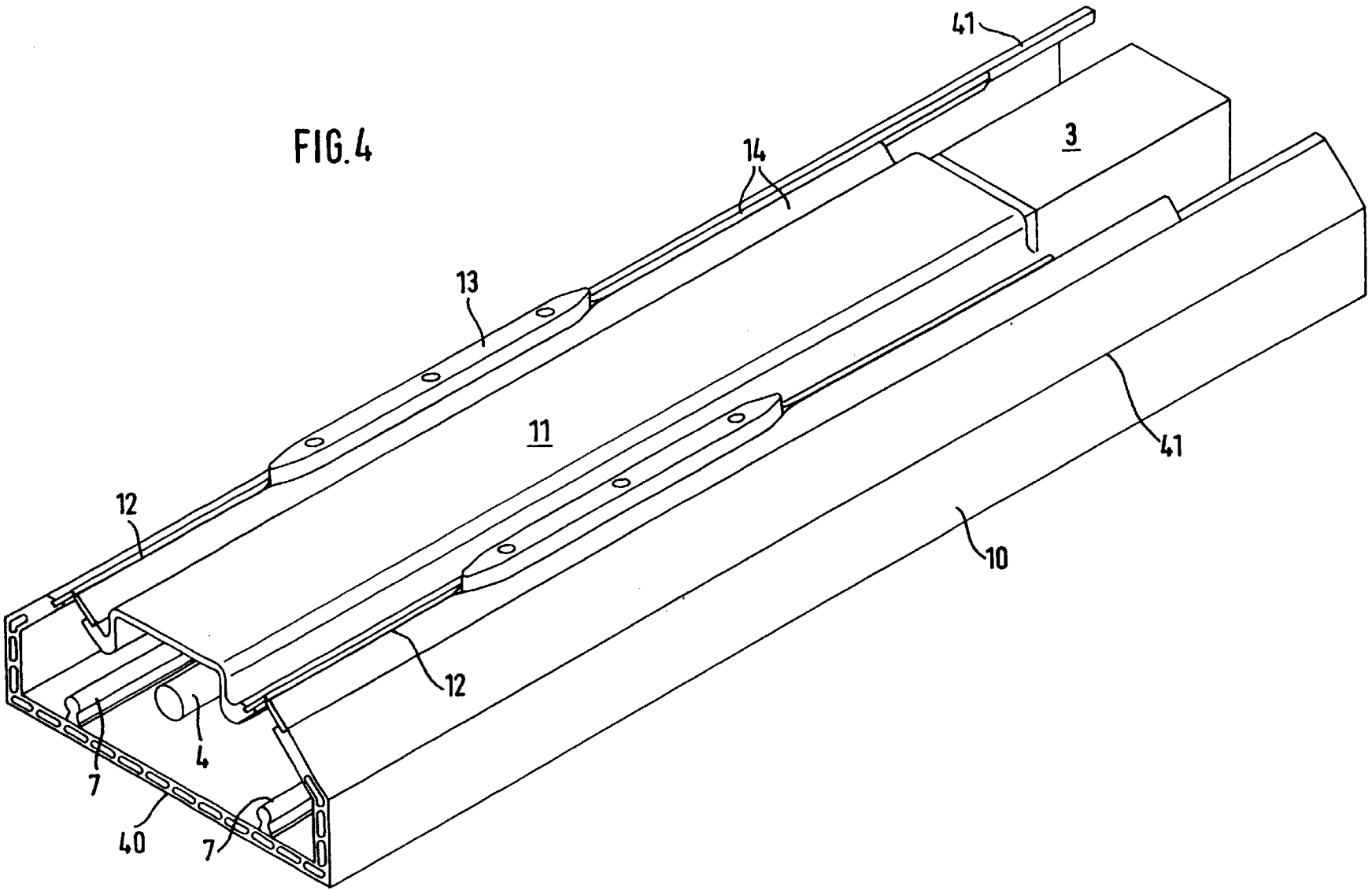
FIG. 4 is a further perspective view of an embodiment of a drive unit with a sealing mechanism.

FIG. 4 shows a perspective representation of an embodiment of a drive unit 2. The external structure of the drive unit 2 is formed by a cage-like profiled rail 10. The profiled rail 10 is provided with a base plate 40 as well as two side walls 41. The side walls 41 are inclined inwards towards the side opposite the base plate 40. A cover 11 is disposed between the side walls 41 of the profiled rail 10. A gap 12 is formed between the cover 11 and a side wall 41 of the profiled rail 10, respectively. In each gap 12, a shuttle 13 is disposed that can be moved in a translatory manner along the gap 12 by the spindle 4 and the motor 3. The translatory movement of the shuttle 13 is guided by two rails 7 on the base plate 40 of the profiled rail 10. In order to prevent dirt coming into the interior of the drive unit 2, the side walls 41 of the profiled rail 10 and the cover 11 are configured with sealing mechanisms, in particular rubber lips 14 that protrude over the gaps 12 and touch them in part. The shuttles 13 are surrounded by the rubber lips 14, wherein the wedge-shape of the shuttle 13 ensures problem-free movement between the rubber lips 14.

Figure 5:
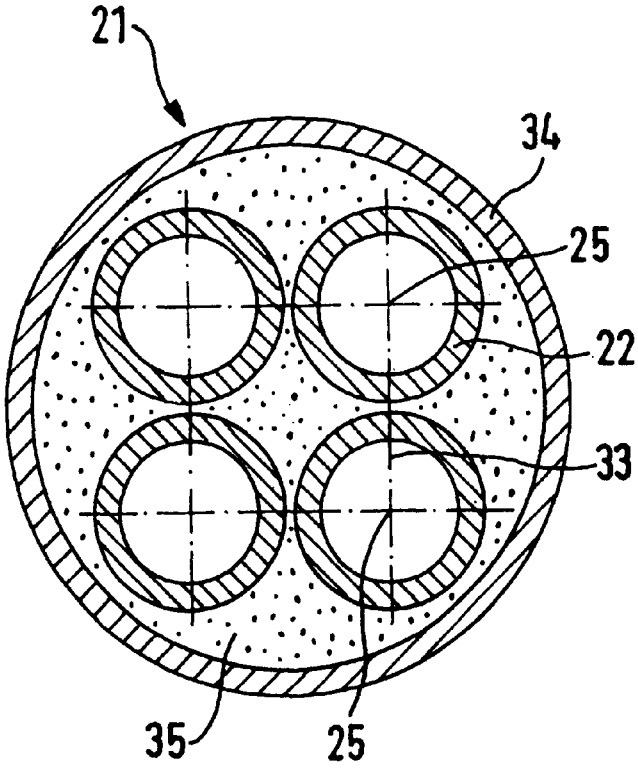
FIG. 5 is a sectional view of an embodiment of the hose system.

FIG. 5 shows a section through a hose system 21 that is configured with four hoses 22. The four hoses 22 are each provided with a cross-section center point 25 that (in the embodiment shown) are disposed at the corners of an imaginary square (33). Furthermore, the hose system 21 is configured with a hose jacket 34 that surrounds the hoses 22. Slipping mechanisms 35 which are located between the hoses 22 in the inside of the hose jacket 34 reduce the friction occurring when the hose system 21 undergoes bending stresses.

Figure 6:
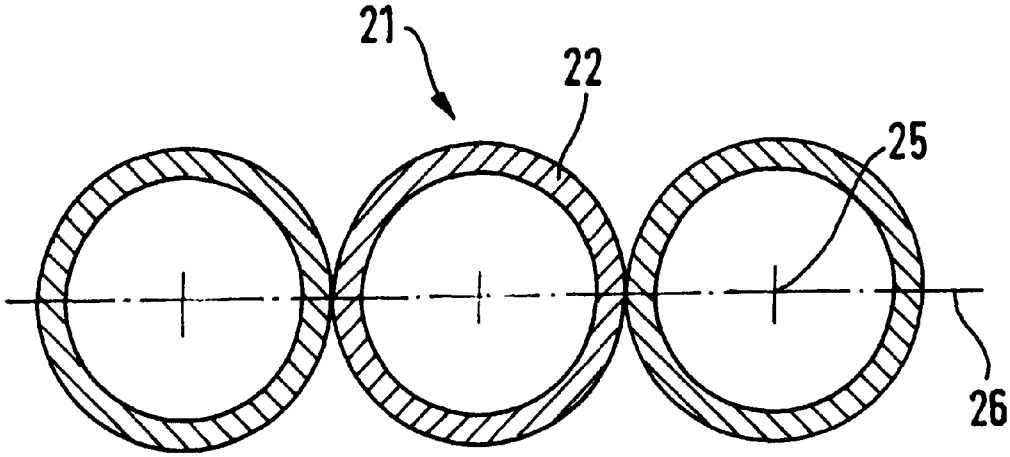
FIG. 6 is a sectional view of a further embodiment of the hose system.

FIG. 6 shows a further configuration of hoses 22 of the hose system 21. The hose system 21 is configured with three hoses 22 that are disposed with their cross-section center points 25 in a straight line 26. If there is a bending of the hose system 21, preferably in a direction perpendicular to the straight line 26, the friction between the hoses 22 is significantly reduced, since (in this case) the hoses 22 always have the same bending radii.

Figure 7:
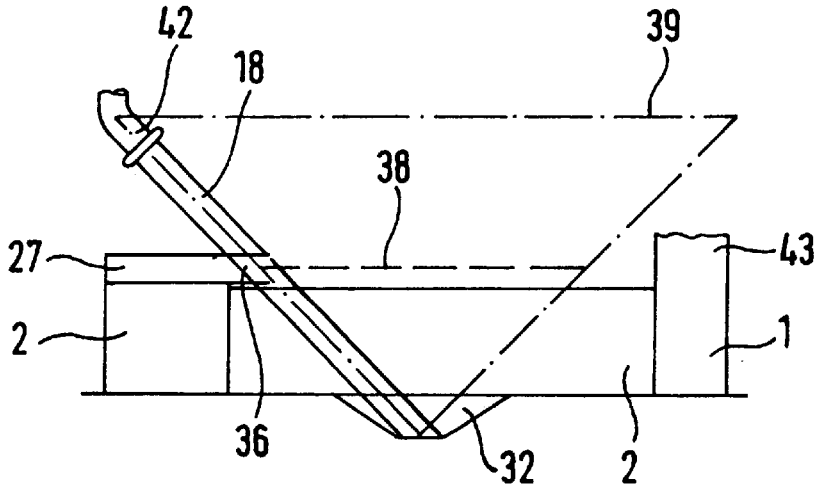
FIG. 7 is a fragmentary, side-elevational view of an embodiment with a water lance in the edge position.
Figure 8:
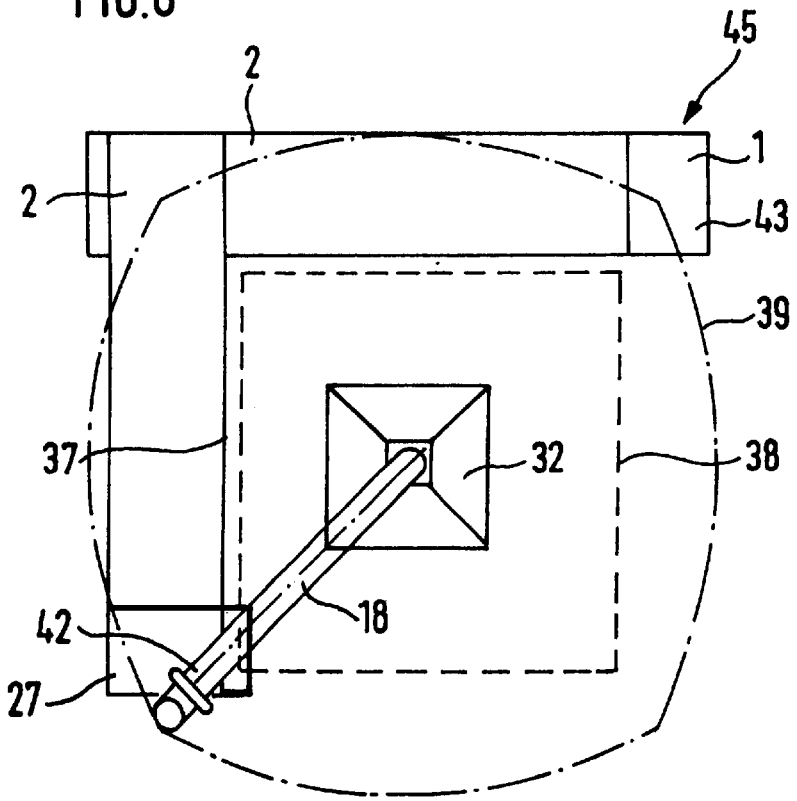
FIG. 8 is a plan view of the embodiment of FIG. 7.

FIG. 7 and FIG. 8 show different diagramatic views of an embodiment of a water lance blower with a water lance 18 that is disposed pivotably in a hatch 32, and illustrate the space-saving configuration of the water lance blower according to the invention. The water lance 18 is shown in an extremely inclined position that occurs when non-illustrated spindle nuts of the two drive units 2 are moved to an end position on the spindle 5. The water lance 18 is moved or pivoted by a connecting element 27 with an end 36 projecting laterally.

During operation of the water lance blower, the position of the water lance 18 changes, whereby it is guided within a pre-determinable range of movement 38 by the connecting element 27. The water lance 18 extends beyond the range of movement 38, wherein the end area 42 of the water lance 18 sweeps over a larger projection surface 39. The projection surface 39 can be seen as the minimum space requirement for the desired course of movement of the water lance. For this reason, the water lance blower according to the invention is configured such that it is located substantially within the projection surface 39. The retaining device 1 with the integrated parts of the water supply system 43 is disposed in a corner 45 of the projection surface 39, so that it faces the side 37 of the vertical drive unit 2, over which the end 36 of the connecting element 27 projects. The space available is thus utilized very well.

The drive units 2 can also be provided with separate cooling, in particular air or water-cooling, integrated into the base plate 40 according to the operating and environmental conditions.

In this way, a water lance blower according to the invention can also be used in particularly hot areas. Channels that are in any case present in the base plate 40, which are necessary for manufacturing such profiled pieces, can be used as cooling channels without affecting the rest of the system.

We claim:

1. A water lance blower to be connected to a water supply system for cleaning a heating installation having a hatch, the water lance blower comprising:

a water lance having a mouth pivotably disposed in the hatch;

a drive system having at least two drive units for controlling said water lance;

a retaining device for attaching the water lance blower to the heating installation; and said retaining device receiving parts of the water supply system integrated into said retaining device.

2. The water lance blower according to claim 1, further comprising a flexible line connected to said retaining device.

3. The water lance blower according to claim 2, wherein said retaining device includes at least one connecting device for connecting a water supply line and at least one connecting element for connecting said flexible line for conducting water to said water lance.

4. The water lance blower according to claim 3, wherein said retaining device includes at least one distributor integrated into said retaining device and wherein said retaining device includes at least two connecting elements for connecting the water supply line.

5. The water lance blower according to claim 2, wherein said flexible line is configured as a flexible hose system having at least two parallel hoses for dividing and distributing a water flow into said hoses.

6. The water lance blower according to claim 5, wherein said hose system has four hoses, each having a cross-section center point, and said cross-section center points form corners of a square.

7. The water lance blower according to claim 5, wherein said hose system is configured with at least three hoses, each having a cross-section center point, and said cross-section center points form a straight line.

8. The water lance blower according to claim 5, wherein said hose system includes a hose jacket at least partially surrounding said hoses, and said jacket contains a slipping mechanism.

9. The water lance blower according to claim 1, wherein said retaining device includes at least one valve of the water supply system integrated into said retaining device.

10. The water lance blower according to claim 1, wherein said water lance has an end area, said end area sweeps a maximum projection surface during operation of the water lance blower, and said parts are disposed and concentrated in an area of a corner of the projection surface.

11. The water lance blower according to claim 1, wherein said two drive units are disposed at right-angles for controlling said water lance and said drive units are configured as exchangeable modules.

12. The water lance blower according to claim 1, further comprising:

a laterally projecting connecting element disposed on said drive unit, said connecting element having an end for articulating said water lance; and said end orienting said connecting element towards a side opposite the parts of the water supply system.

13. The water lance blower according to claim 1, wherein said drive unit includes a motor, a spindle to be turned by said motor, a guidance system having slide shoes and rails, and a spindle nut to be moved in a translatory manner.

14. The water lance blower according to claim 13, wherein said spindle nut is guided by said guidance system with said slide shoes and said rails.

15. The water lance blower according to claim 14, further comprising a fastening element for connecting said slide shoes.

16. The water lance blower according to claim 15, wherein said fastening element includes positioning aids for an accurate orientation of structures to be attached to said fastening element.

17. The water lance blower according to claim 15, wherein said positioning aids are configured as at least one of pins, grooves and bores.

18. The water lance blower according to claim 15, wherein one of said drive units is to be attached to said fastening element of the other of said drive units.

19. The water lance blower according to claim 15, wherein said drive unit has a cage-shaped profiled rail and a cover for at least partially enclosing components of said drive unit being sensitive to soiling.

20. The water lance blower according to claim 19, wherein said fastening element is disposed outside said cage-shaped profiled rail and is connected through at least one gap to said slide shoes in an interior of said profiled rail.

21. The water lance blower according to claim 20, further comprising: at least one expansion bellows, said bellows at least partially sealing the at least one gap between said profiled rail and said cover.

22. The water lance blower according to claim 20, further comprising:

a rail and a shuttle; and said slide shoe connecting to said rail by said shuttle with said fastening element disposed in the gap between said profiled rail and said cover;

said profiled rail and said cover including rubber lips extending over the gap.

23. The water lance blower according to claim 22, wherein said rubber lips at least partially touch one another and lie against said shuttle.

24. The water lance blower according to claim 19, wherein said profiled rail is configured for receiving air at over-pressure and the air substantially disperses through the gap between said profiled rail and said cover.

25. The water lance blower according to claim 1, wherein said retaining device includes integrated steering components for said drive system and for forming and monitoring a water jet.

26. The water lance blower according to claim 25, wherein said retaining device includes at least one of control indicators and operating elements for influencing said steering components.

27. The water lance blower according to claim 1, wherein said retaining device includes connectors for one of a remote control and remote diagnostics operation.

* * * * *